US008251708B2

(12) United States Patent
Huang

(10) Patent No.: US 8,251,708 B2
(45) Date of Patent: Aug. 28, 2012

(54) CONNECTION APPARATUS AND CONNECTION METHOD THEREOF

(75) Inventor: Fa-Sheng Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 93 days.

(21) Appl. No.: 12/915,036

(22) Filed: Oct. 29, 2010

(65) Prior Publication Data

US 2012/0077354 A1 Mar. 29, 2012

(30) Foreign Application Priority Data

Sep. 23, 2010 (CN) ..... 2010 1 0289396

(51) Int. Cl.
*H01R 29/00* (2006.01)

(52) U.S. Cl. ..... 439/54; 439/912

(58) Field of Classification Search ..... 439/43, 439/49, 54, 55, 481–483, 912; 324/538
See application file for complete search history.

(56) References Cited

U.S. PATENT DOCUMENTS

| | | | | |
|---|---|---|---|---|
| 6,039,578 | A * | 3/2000 | Suffi et al. | 439/54 |
| 6,123,564 | A * | 9/2000 | Belmore, III | 439/344 |
| 7,489,987 | B2 * | 2/2009 | Heiland et al. | 700/280 |
| 7,513,776 | B1 * | 4/2009 | Chen et al. | 439/54 |
| 8,079,871 | B2 * | 12/2011 | Ye | 439/596 |

* cited by examiner

*Primary Examiner* — Khiem Nguyen
(74) *Attorney, Agent, or Firm* — Altis Law Group, Inc.

(57) ABSTRACT

A connection apparatus used to connect a connector to a test apparatus includes a main board, a first connector, and a number of second connectors. The main board includes a number of pins arrayed a 9*10 matrix, the nine lines defined as A-I, the ten rows defined as 1-10. The second connectors are respectively connected to the pins A5, B5, D5, E5, G5, H5, B6, C6, E6, F6, H6, and I6 of the main board. The pins of main board in the 1-6 rows, the 3-8 rows and the 5-10 rows are respectively connected to the connector to be tested by the first connector. Signal transmission of the connector is input to the circuit board and output to the test apparatus by the second connectors.

4 Claims, 10 Drawing Sheets

| | 01 | 02 | 03 | 04 | 05 | 06 |
|---|---|---|---|---|---|---|
| I | $GND_{RG}$ | $HS8_BA-_{HS}$ | $GND_{RG}$ | $STANDBY_PWR_{LS}$ | $GND_{RG}$ | $HS7_AB-_{HS}$ |
| H | $LS8-BA_{LS}$ | $HS8_BA+_{HS}$ | $HS8_AB-_{HS}$ | $AC-GOOD_L_{LS}$ | $HS7_BA-_{HS}$ | $HS7_AB+_{HS}$ |
| G | $LS8-AB_{LS}$ | $GND_{LG}$ | $HS8_AB+_{HS}$ | $GND_{LG}$ | $HS7_BA+_{HS}$ | $GND_{LG}$ |
| F | $GND_{LG}$ | $HS5_BA-_{HS}$ | $GND_{LG}$ | $HS3_BA-_{HS}$ | $GND_{LG}$ | $HS1_BA-_{HS}$ |
| E | $HS6_BA-_{HS}$ | $HS5_BA+_{HS}$ | $HS4_BA-_{HS}$ | $HS3_BA+_{HS}$ | $HS2_BA-_{HS}$ | $HS1_BA+_{HS}$ |
| D | $HS6_BA+_{HS}$ | $GND_{RG}$ | $HS4_BA+_{HS}$ | $GND_{RG}$ | $HS2_BA+_{HS}$ | $GND_{RG}$ |
| C | $GND_{RG}$ | $HS5_AB-_{HS}$ | $GND_{RG}$ | $HS3_AB-_{HS}$ | $GND_{RG}$ | $HS1_AB-_{HS}$ |
| B | $HS6_BA-_{HS}$ | $HS5_AB+_{HS}$ | $HS4_AB-_{HS}$ | $HS3_AB+_{HS}$ | $HS2_AB-_{HS}$ | $HS1_AB+_{HS}$ |
| A | $HS6_BA+_{HS}$ | $GND_{RG}$ | $HS4_AB+_{HS}$ | $GND_{RG}$ | $HS2_AB+_{HS}$ | $GND_{RG}$ |

FIG. 7
(RELATED ART)

| | 01 | 02 | 03 |
|---|---|---|---|
| I | $GND_{RG}$ | $DRIVE_5_TX-_{HS}$ | $GND_{RG}$ |
| H | $DRIVE_6_TX-_{HS}$ | $DRIVE_5_TX+_{HS}$ | $DRIVE_4_TX-_{HS}$ |
| G | $DRIVE_6_TX+_{HS}$ | $GND_{LG}$ | $DRIVE_4_TX+_{HS}$ |
| F | $GND_{LG}$ | $DRIVE_5_RX-_{HS}$ | $GND_{LG}$ |
| E | $DRIVE_6_RX-_{HS}$ | $DRIVE_5_RX+_{HS}$ | $DRIVE_4_RX-_{HS}$ |
| D | $DRIVE_6_RX+_{HS}$ | $GND_{RG}$ | $DRIVE_4_RX+_{HS}$ |
| C | $DRIVE_6_INPL_L_{LS}$ | $DRIVE_5_INPL_L_{LS}$ | $DRIVE_4_INPL_L_{LS}$ |
| B | $DRIVE_6_GPO_L_{LS}$ | $DRIVE_5_GPO_L_{LS}$ | $DRIVE_4_GPO_L_{LS}$ |
| A | $DRIVE_6_FAULT_L_{LS}$ | $DRIVE_5_FAULT_L_{LS}$ | $DRIVE_4_FAULT_L_{LS}$ |

FIG. 8A
(RELATED ART)

| 04 | 05 | 06 |
|---|---|---|
| DRIVE_3_TX−$_{HS}$ | GND$_{RG}$ | DRIVE_1_TX−$_{HS}$ |
| DRIVE_3_TX+$_{HS}$ | DRIVE_2_TX−$_{HS}$ | DRIVE_1_TX+$_{HS}$ |
| GND$_{LG}$ | DRIVE_2_TX+$_{HS}$ | GND$_{LG}$ |
| DRIVE_3_RX−$_{HS}$ | GND$_{LG}$ | DRIVE_1_RX−$_{HS}$ |
| DRIVE_3_RX+$_{HS}$ | DRIVE_1_RX−$_{HS}$ | DRIVE_1_RX+$_{HS}$ |
| GND$_{RG}$ | DRIVE_1_RX+$_{HS}$ | GND$_{RG}$ |
| DRIVE_3_INPL_L$_{LS}$ | DRIVE_2_INPL_L$_{LS}$ | DRIVE_1_INPL_L$_{LS}$ |
| DRIVE_3_GPO_L$_{LS}$ | DRIVE_2_GPO_L$_{LS}$ | DRIVE_1_GPO_L$_{LS}$ |
| DRIVE_3_FAULT_L$_{LS}$ | DRIVE_2_FAULT_L$_{LS}$ | DRIVE_1_FAULT_L$_{LS}$ |

FIG. 8B
(RELATED ART)

CONNECTION APPARATUS AND CONNECTION METHOD THEREOF

BACKGROUND

1. Technical Field

The disclosure generally relates to connection apparatuses, particularly to a connection apparatus and connection method for testing Storage Bridge Bay Midplane Interconnect (SBBMI) devices.

2. Description of Related Art

The SBB working group is a nonprofit corporation formed by industry members to develop and distribute specification standardization of storage enclosures. The SBB specification defines the SBBMI interface for connection of storage control cards and storage units, such as hard disks. The storage control card exchanges information with the storage unit by a SBBMI interface.

Thirteen types of SBBMI connectors named M1-M13 according to the SBB specification are defined to connect the storage control card and the hard disk. Referring to FIGS. 7-9, pins of the connector M1-M13 are arrayed in 9*6 matrixes. The nine lines are defined as A-I. The six rows are defined as 01-06. The pins are defined as the combination of the corresponding line and row such as the pin A01 and A02. 15 pairs of the pins A01/B01, D01/E01, B02/C02, E02/F02, H02/I02, A03/B03, D03/E03, G03/H03, B04/C04, E04/F04, A05/B05, D05/E05, G05/H05, B06/C06, and E06/F06 of the connector are used to connect two storage cards. Twelve pairs of pins D01/E01, G01/H01, E02/F02, H02/I02, D03/E03, G03/H03, E04/F04, H04/I04, D05/E05, G05/H05, E06/F06, and H06/I06 are used to connect a storage control card to a hard disk.

During manufacturing, signal transmissions of the connectors M1-M13 are usually tested by a test apparatus such as an oscilloscope. However, multiple connectors corresponding to the connectors M1-M13 are needed to connect the connectors M1-M13 for their excessive pins.

Therefore, there is room for improvement within the art.

BRIEF DESCRIPTION OF THE DRAWINGS

Many aspects of the connection apparatus and the connection method thereof can be better understood with reference to the following drawings. The components in the drawings are not necessarily drawn to scale, the emphasis instead being placed upon clearly illustrating the principles of the connection apparatus and the connection method thereof.

FIG. 7 is a table of definition of pins of the conventional connector M1 and M5.

FIGS. 8A and 8B are tables of definition of pins of the conventional connector M2, and M7-M13.

DETAILED DESCRIPTION

Figure 1:
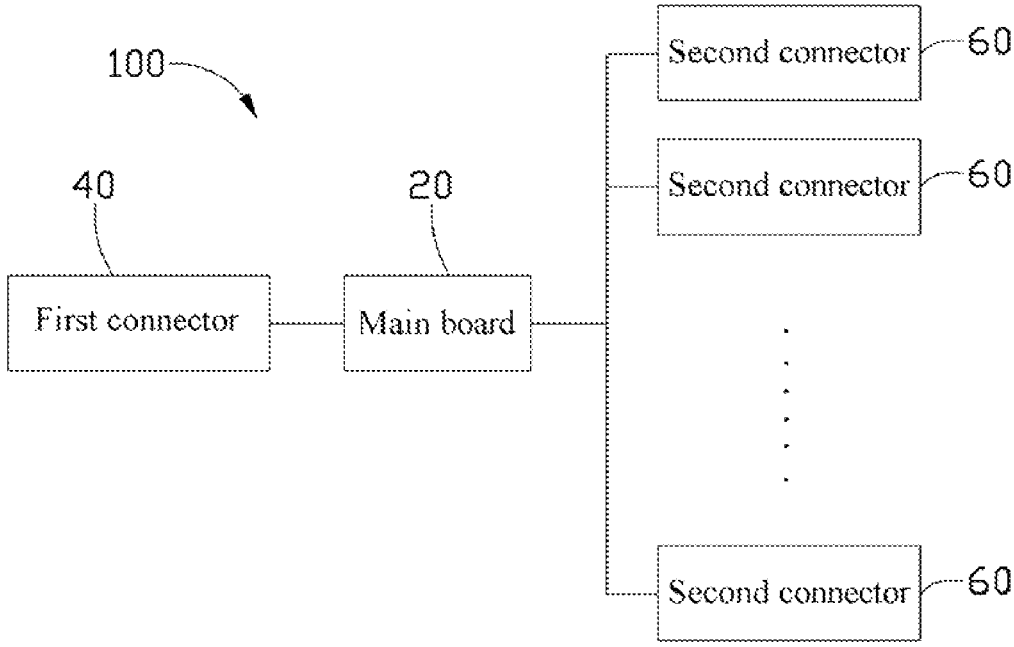
FIG. 1 is a block diagram of a connection apparatus, according to an exemplary embodiment.

FIG. 1 shows a connection apparatus 100 used to connect a connector to be tested, such as connector M1-M13, to a test apparatus, according to an exemplary embodiment. The connection apparatus 100 includes a main board 20, and a first connector 40 and a plurality of second connectors 60. The first connector 40 and the second connectors 60 are connected to the main board 20. The first connector 40 is used to connect to the connector to be tested. The second connectors 60 are used to connect to the test apparatus. Signal transmission of the connector to be tested is input to the first connector 40, sent to the second connectors 60 by the main board 20, and finally output to the test apparatus with the second connectors 60.

Figure 2:
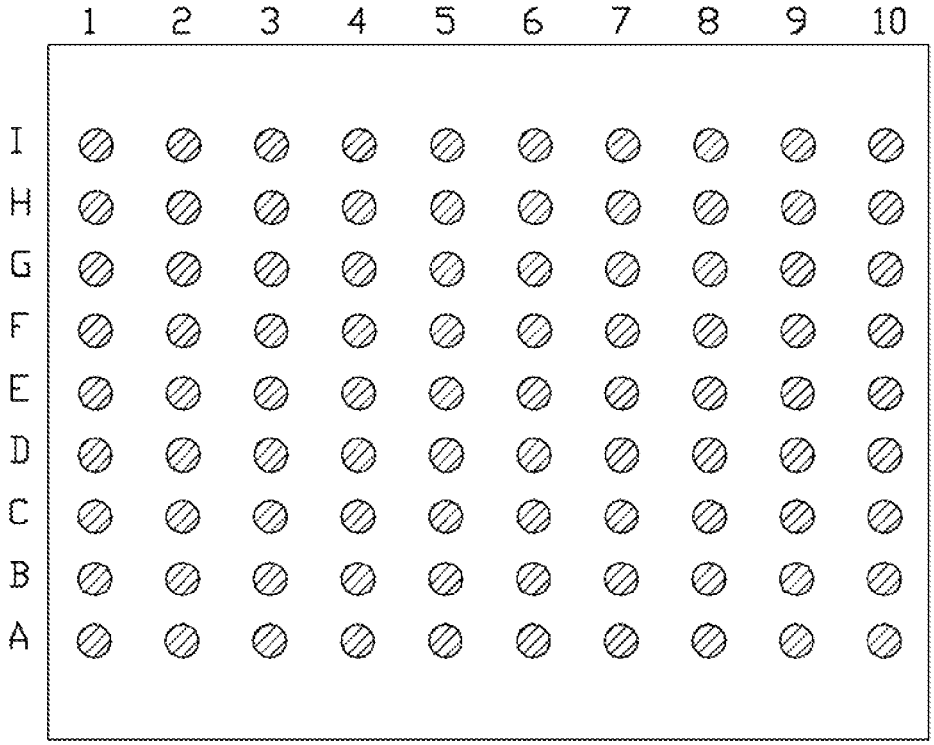
FIG. 2 is a schematic view of pins of one embodiment of a main board of the connection apparatus of FIG. 1.
Figure 3:
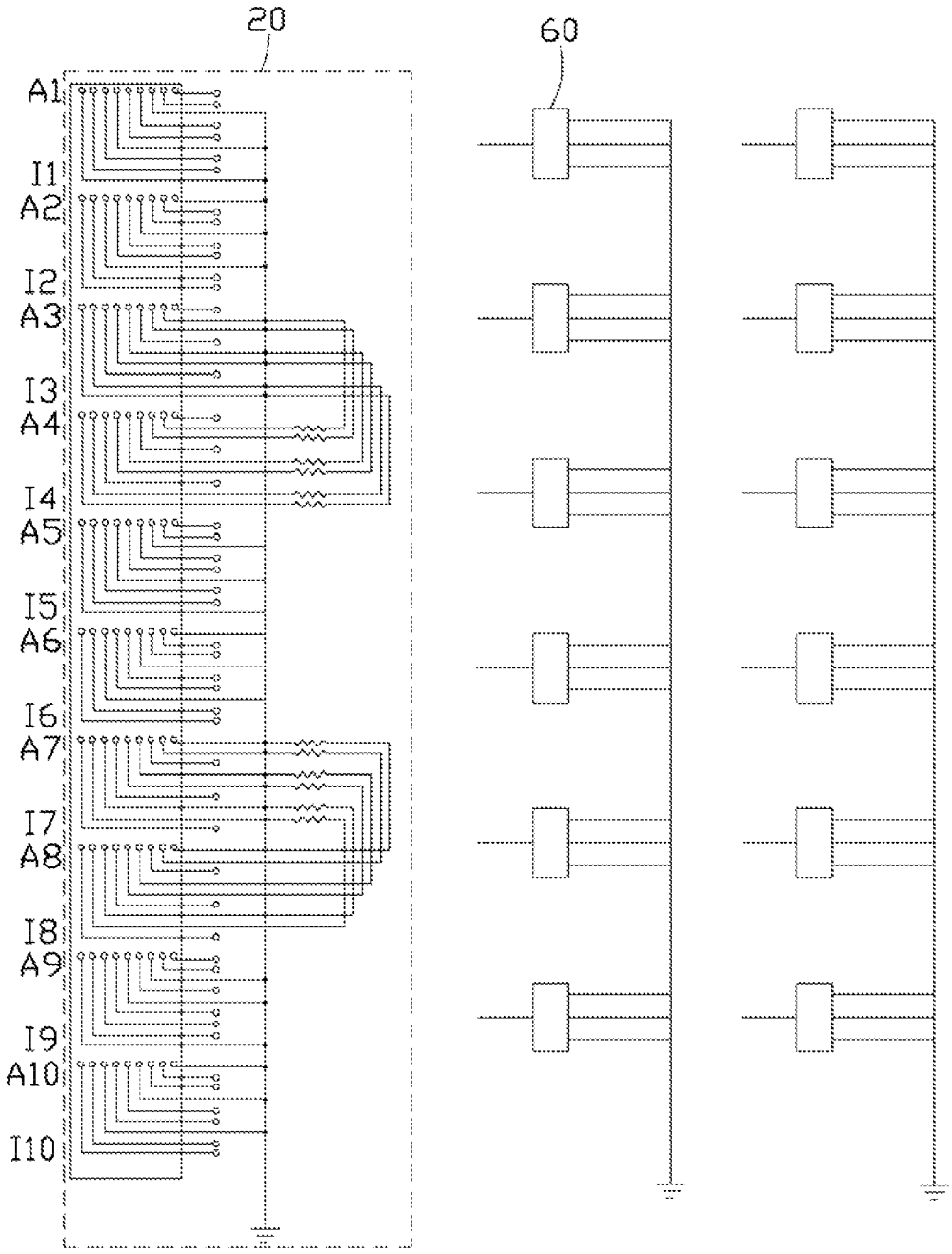
FIG. 3 is a partial circuit diagram of the connection apparatus of FIG. 1.

Referring to FIGS. 2 and 3, the main board 20 is a printed circuit board. The main board 20 includes a plurality of pins arrayed in a 9*10 matrix. The nine lines are defined as A-I; the ten rows are defined as 1-10; and the pins are defined as the combination of the corresponding line and row such as the pin A1 and A2. The pins A5, B5, D5, E5, G5, H5, B6, C6, E6, F6, H6, and I6 are respectively connected to one of the second connectors 60. The pins C1, F1, I1, A2, D2, G2, C3, F3, I3, A4, D4, G4, C5, F5, I5, A6, D6, G6, C7, F7, I7, A8, D8, G8, C8, C9, F9, I9, A10, D10, and G10 are grounded.

The first connector 40 is corresponding to the connector to be tested. The first connector 40 is detachably assembled to the main board 20, inputs signal transmission of the connector to be tested to the main board 20.

The second connectors 60 connect the pins A5, B5, D5, E5, G5, H5, B6, C6, E6, F6, H6, and I6 to the test apparatus. In this exemplary embodiment, the number of the second connectors 60 is twelve.

During use of the connection apparatus 100 to connect the connector to be tested to the test apparatus, the pins of the connector to be tested are divided into three groups. The first group of pins are A01/B01, D01/E01, G01/H01, B02/C02, E02/F02, H02/I02. the second group of pins are A03/B03, D03/E03, G03/H03, B04/C04, E04/F04, H04/I04. The third group of pins are A05/B05, D05/E05, G05/H05, B06/C06, E06/F06, H06/I06.

Figure 4:
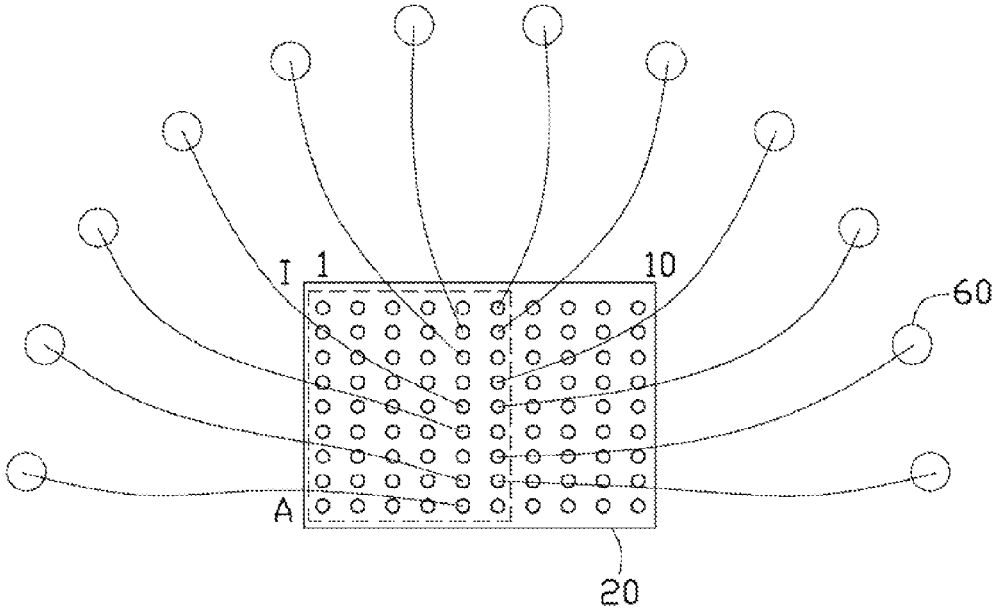
FIGS. 4-6 are schematic views of the main board and a first connector, when respectively using the connection apparatus to test a first group, a second group and a third group of pins of the connector to be tested.

Referring to FIG. 4, to test the first group of pins, the first connector 40 is connected to the pins of the main board 20, which is arrayed in the rows 1-6. Therefore, signals transmission of the first connector 40 of the first group can be input to the main board 20 by the first connector 40, and output to the test apparatus by the second connectors 60.

Figure 5:
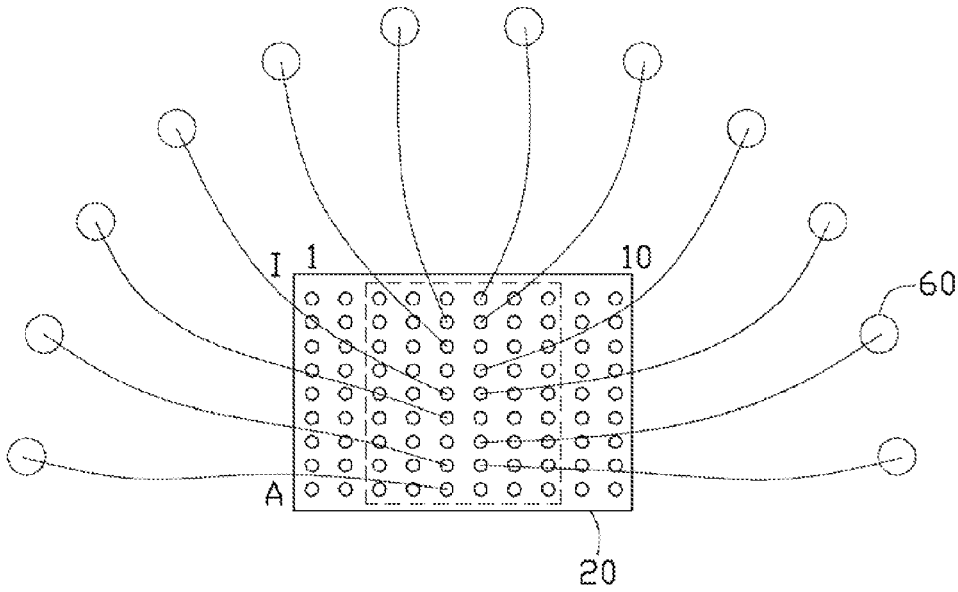

Referring to FIG. 5, to test the second group of pins, the first connector 40 is connected to the pins of the main board 20, which is arrayed in the rows 3-8. Therefore, signal transmission of the first connector 40 of the second group can be input to the main board 20 by the first connector 40, and output to the test apparatus by the second connectors 60.

Figure 6:
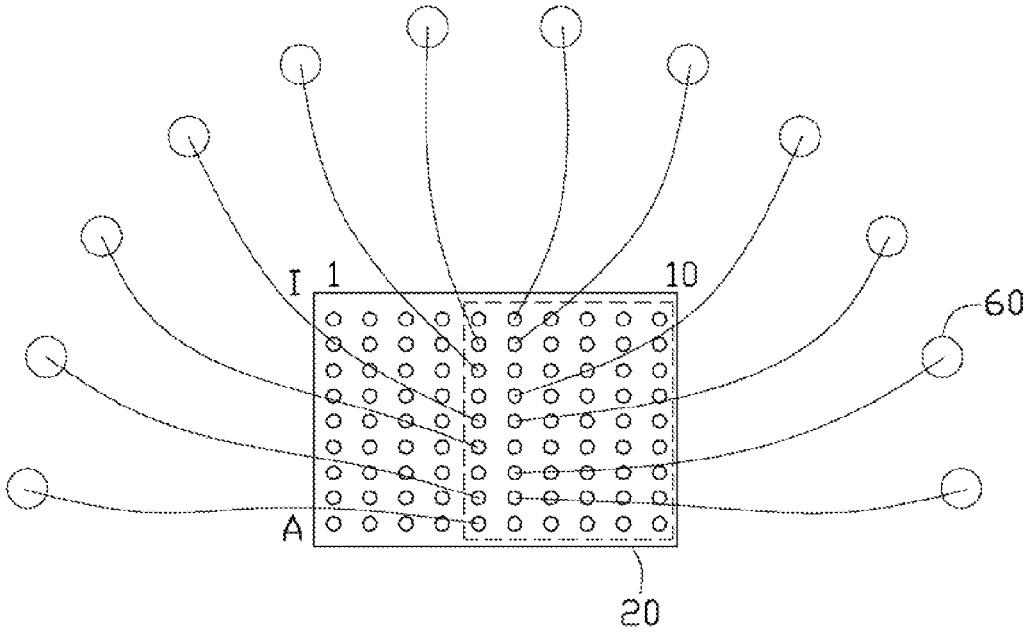
Figure 9:
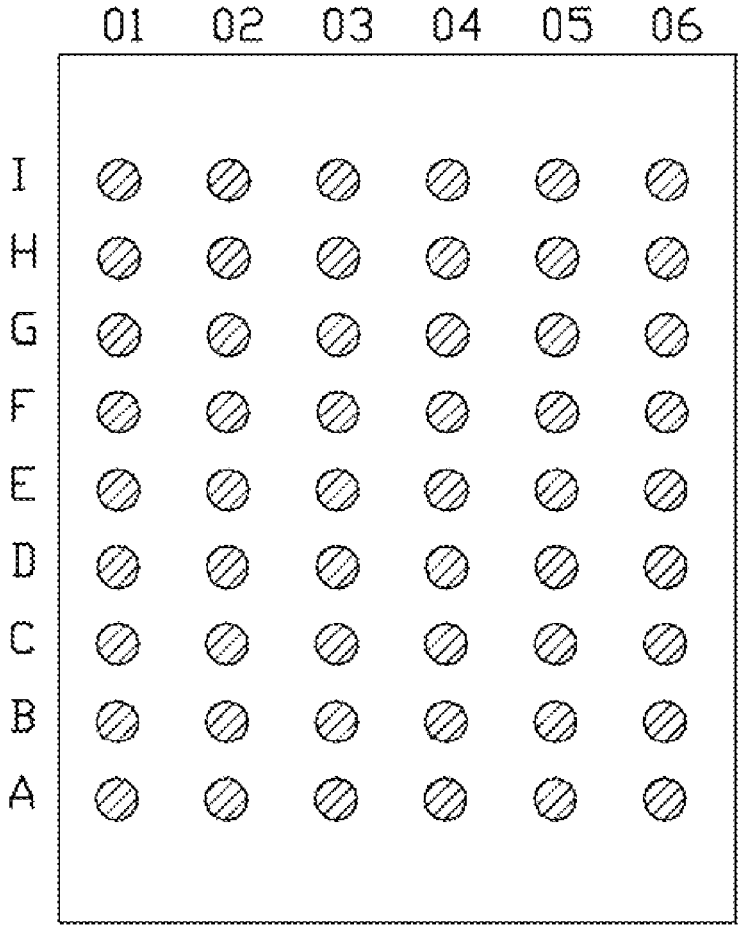
FIG. 9 (RELATED ART)
FIG. 9 is a schematic view of pins of the conventional connectors M1-M13.

Referring to FIG. 6, to test the third group of pins, the first connector 40 is connected to the pins of the main board 20 which is arrayed in the rows 5-10. Therefore, the signal transmission of the first connector 40 of the third group can be input to the main board 20 by the first connector 40, and output to the test apparatus by the second connectors 60.

The pins A5, B5, D5, E5, G5, H5, B6, C6, E6, F6, H6, and I6 are connected to the second connectors 60. The connection apparatus 100 outputs signal transmission for all pins of the connector to be tested to the test apparatus by connecting the pins in different rows of the main board 20 to the first connector 40. Therefore, only one first connector 40 is used during the testing process.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A connection apparatus used to connect a connector to a test apparatus; comprising:

a circuit board including a plurality of pins arrayed in a 9*10 matrix, the nine lines defined as A-I, the ten rows defined as 1-10;

a first connector; and a plurality of second connectors connecting to the pins A5, B5, D5, E5, G5, H5, B6, C6, E6, F6, H6, and I6; wherein the pins in the 1-6 rows, the 3-8 rows and the 5-10 rows are respectively connected to the connector by the first connector, and wherein signal transmission of the connector is input to the circuit board and output to the test apparatus by the second connectors.

2. The connection apparatus as claimed in claim 1, wherein the pins C1, F1, I1, A2, D2, G2, C3, F3, I3, A4, D4, G4, C5, F5, I5, A6, D6, G6, C7, F7, I7, A8, D8, G8, C8, C9, F9, I9, A10, D10, and G10 are grounded.

3. The connection apparatus as claimed in claim 2, wherein the first connector is detachably inserted in the circuit board.

4. The connection apparatus as claimed in claim 3, wherein pins of the connector are arrayed in a 9*6 matrix.

* * * * *